United States Patent [19]

Gloeckler

[11] 4,169,707

[45] Oct. 2, 1979

[54] PROCESS FOR TREATMENT OF YARN WITHIN A STEAMING CHAMBER

[75] Inventor: Alfred M. Gloeckler, Riedisheim, France

[73] Assignee: Etablissements Superba S.A., Mulhouse, France

[21] Appl. No.: 847,655

[22] Filed: Nov. 1, 1977

[30] Foreign Application Priority Data

Nov. 4, 1976 [AT] Austria ..... 8207/76

[51] Int. Cl.[2] ..... D06B 3/04

[52] U.S. Cl. ..... 8/149.3; 28/281; 68/5 D

[58] Field of Search ..... 8/149.2, 149.3, 151.2; 68/5 D, 5 E; 28/281; 57/34 HS; 34/24, 155

[56] References Cited

U.S. PATENT DOCUMENTS

| | | | |
|---|---|---|---|
| 3,286,493 | 11/1966 | Ogino et al. | 68/5 E |
| 3,318,013 | 5/1967 | Erb | 68/5 D X |
| 3,606,655 | 9/1971 | Oberlander et al. | 8/149.3 X |
| 3,838,968 | 10/1974 | Fleissner | 8/149.3 |

FOREIGN PATENT DOCUMENTS

| | | | |
|---|---|---|---|
| 2123540 | 11/1972 | Fed. Rep. of Germany . | |
| 2344046 | 3/1974 | Fed. Rep. of Germany | 28/281 |
| 2441739 | 3/1975 | Fed. Rep. of Germany . | |
| 2225371 | 11/1974 | France . | |

*Primary Examiner*—Philip R. Coe

*Attorney, Agent, or Firm*—Cushman, Darby & Cushman

[57] ABSTRACT

The process comprises the steps of depositing the yarn onto a conveyor belt in the form of a cohesive flexible continuous hollow cylindrical winding of yarns, said cylindrical winding being supported on said conveyor belt at least along a generatrix of said cylinder, said cylindrical winding being transported through a hood-shaped steaming chamber while following a conveying pass successively ascending, horizontal and descending, the treatment fluid being maintained air-free and pure within said chamber owing to relative specific weight effect.

9 Claims, 8 Drawing Figures

PROCESS FOR TREATMENT OF YARN WITHIN A STEAMING CHAMBER

FIELD OF THE INVENTION

The present invention relates to a process for a continuous steaming of fibers in a steaming chamber.

DESCRIPTION OF THE PRIOR ART

Steaming treatment processes are already known in which a yarn or several previously assembled yarns are deposited by a depositing head in form of windings or coilings onto a conveyor belt and are transported by said conveyor belt through a treatment chamber containing a treatment fluid such as saturated or superheated steam, the yarns being taken up at the delivery end of the conveyor belt by a taking up apparatus which is mechanically and electrically synchronized with the depositing head for depositing the yarn onto the conveyor belt to achieve a continuous automatic treatment process.

For a high speed automatic treatment, the processes of the Prior Art present many drawbacks. On one hand, the amount of yarn which is deposited in the form of windings on the conveyor belt is quite limited owing to the substantially bi-dimentional ordering of the yarn onto said belt. On the other hand, said belt which carries the yarn windings passes substantially horizontally below the treatment chamber and therefore, which such an arrangement, the yarn is treated in a zone where the treatment fluid, more particularly steam, is not pure since said zone substantially corresponds to the level of the separation zones between the pure treatment fluid within the chamber and the surrounding atmosphere. This results additionally in treatment fluid losses which induce a decreasing of the temperature in the treatment chamber resulting accordingly in unprofitable losses of energy.

Moreover, in the apparatus designed to carry out the processes of the Prior Art, since the yarn or the yarns are treated in a zone where the steam is not pure, it is not possible to achieve a treatment with the maximum desirable temperature for the treatment fluid whereby resulting in a limitation of the efficiency of the apparatus.

OBJECTS OF INVENTION

It is the object of the invention to obviate the drawbacks of the Prior Art processes by providing a process for treatment of yarns in a heat treatment chamber, for instance with saturated or superheated steam, allowing on one hand the amount of yarn to be treated to be substantially increased for a predetermined dimentioning of the treatment chamber, and on the other hand to have the treatment efficiency improved by submitting the yarn or the yarns to a heat treatment in a zone where the treatment fluid is pure, more particularly air-free.

There is another object of the invention to provide a process for heat treatment of yarns ensuring a considerable reduction of the treatment fluid losses and allowing the temperature of said fluid treatment to be increased till the maximum value required for an optimum treatment of the yarns.

SUMMARY OF THE INVENTION

In order to meet these objects, it is a characteristic of the present invention that such a heat treatment process consists in depositing the yarn or the pre-assembled yarns on the conveyor belt in the form of a cylindrical winding having an annular cross-section and forming a hollow continuous flexible cylinder, said winding cylinder being supported along at least a generatrix thereof on the conveyor belt which transports said winding cylinder into and through a treatment chamber of a bell type in which the treatment fluid is maintained in a pure state as a result of a relative density effect.

It is another characteristic of the present invention that the cylindrical winding of yarns to be deposited onto the conveyor belt is obtained through the cooperation of a depositing head which presents in a substantially vertical outlet plane a depositing disc adapted to rotate around an axis which is in turn adapted to rotate around another axis parallel to the rotation axis of the depositing plate and of a stuffing means arranged downstream with respect to the travelling direction of the yarn, substantially co-axially to the general rotation axis of the depositing head, so as to form a hollow continuous cylindrical winding having controllable inner and outer diameters, said cylindrical winding being made of a plurality of annular successive turn layers in more or less jointing relationship.

The present invention will be further understood from the following detailed description of a preferred embodiment and the accompanying drawings, wherein:

DETAILED DESCRIPTION OF THE DRAWINGS

Figure 1:
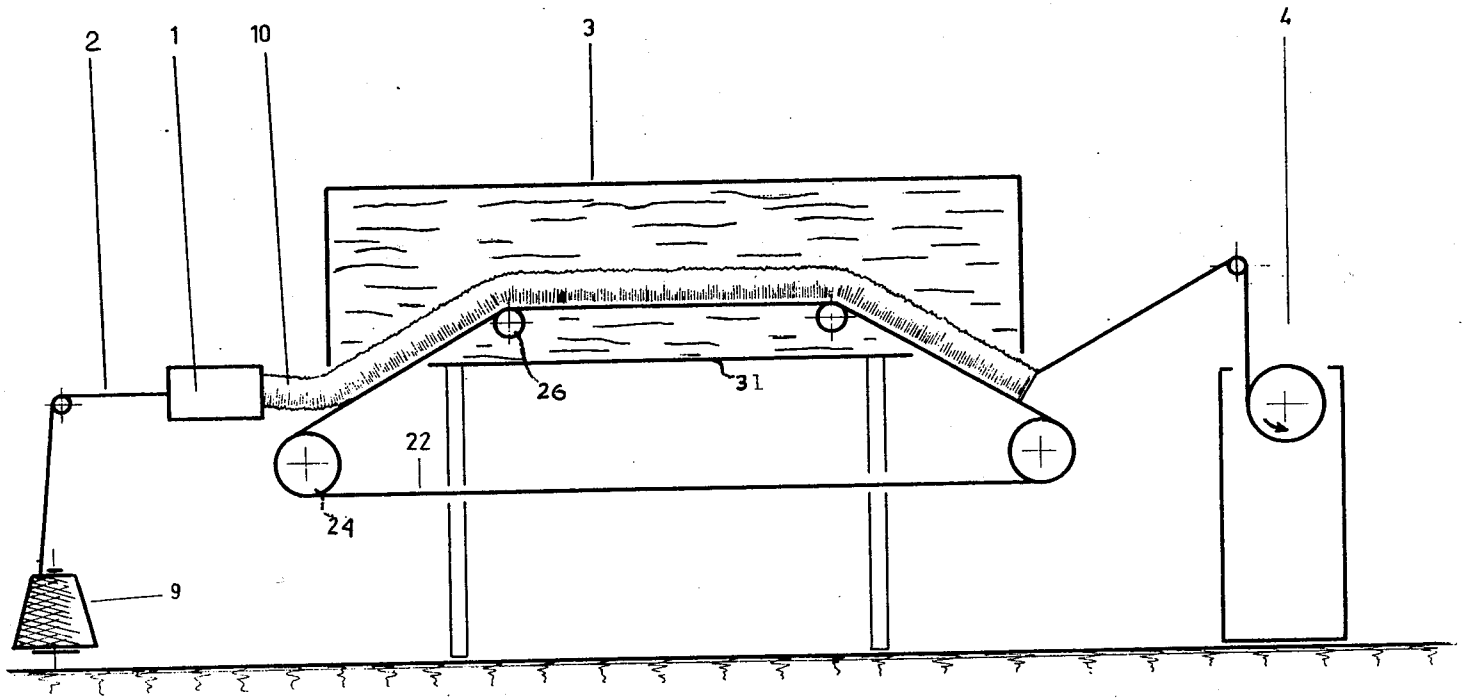
FIG. 1 schematically shows an apparatus to carry out the process of invention.

FIG. 1 schematically shows a heat treatment apparatus for carrying out a process according to the invention. With reference to said FIG. 1, a forming and depositing device 1 for depositing the yarn to be treated cooperates with a conveyor belt 22 adapted to support and convey the yarn or the pre-assembled yarns to be treated so as to transport same through a heat treatment chamber 3 containing the treatment fluid. While leaving the treatment chamber 3, the yarn which has been treated is re-wound by a taking up apparatus which is synchronized with the conveyor belt and the depositing head of the yarn depositing device. The yarn forming and depositing device 1 is fed with the yarn to be treated 2 from a supplying spool 9 and realizes a cylindrical winding or torus coil 10 which is deposited on the conveyor belt 22 and transported by said belt along a conveying pass which, according to the invention, conveys the yarn to be treated within a hood shaped treatment chamber of the bell type 3 within which the treatment fluid, having generally a density lower than air, is maintained in a state of high purity allowing the yarn to be treated with a treatment fluid brought to the maximum allowable treatment temperature with respect to the ambient atmospheric pressure surrounding the apparatus.

Figure 2:
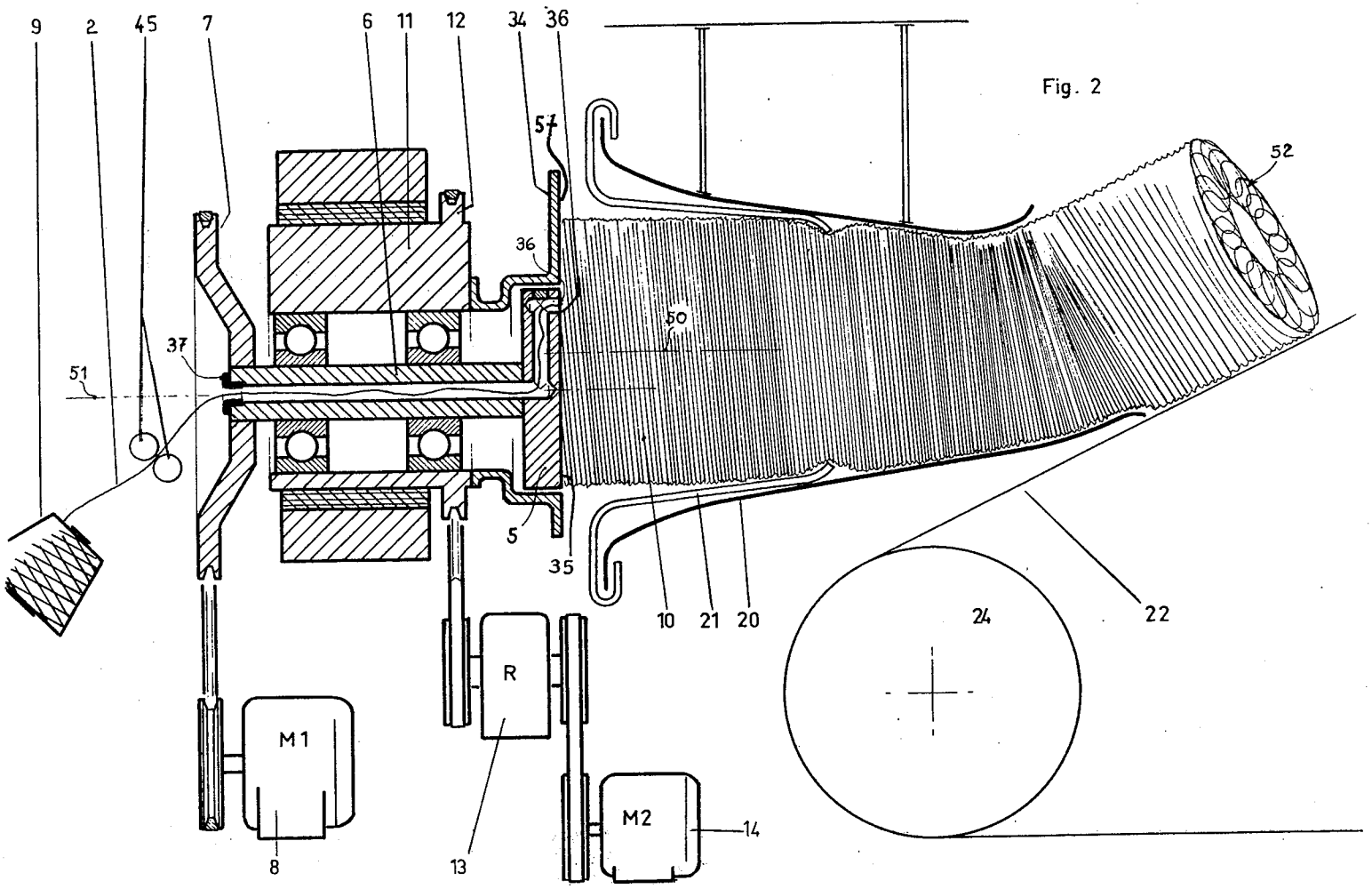
FIG. 2 schematically shows, partially in cross section, the means for forming the continuous cylindrical winding of yarns to be conveyed through the treatment chamber.

FIG. 2 illustrates an embodiment of the depositing device for forming the cylindrical winding 10 of the yarn or yarns to be treated. Said device essentially consists in a depositing disc 5 mounted to the end of a shaft 6 which is rotatably driven by a motor 8 through a pulley 7. The depositing disc 5 is provided with a depositing face 35 having a highly finished surface condition which is disposed in a substantially vertical plane. An extraction orifice for the yarn 36 opens in said depositing face 35 of the dispositing disc 5 in the vicinity of its periphery. The rotating unit comprised by the depositing disc 5 and its driving shaft 6 is rotatably mounted in a sheave body 11 which is adapted for rotating motion around an imaginary axis designated by 50 on FIG. 2, and which is rotatably driven by a motor 14 through a reducing gear 13 and a pulley means 12.

Figure 8:
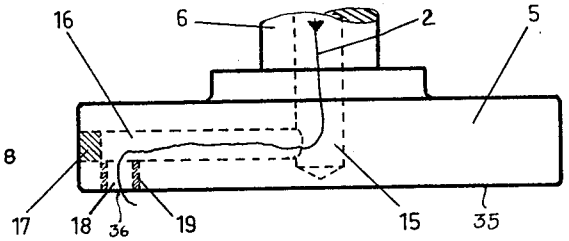
FIG. 8 is a partial cross sectional view, at an enlarged scale, of the depositing disc shown on FIG. 2.
Figure 7:
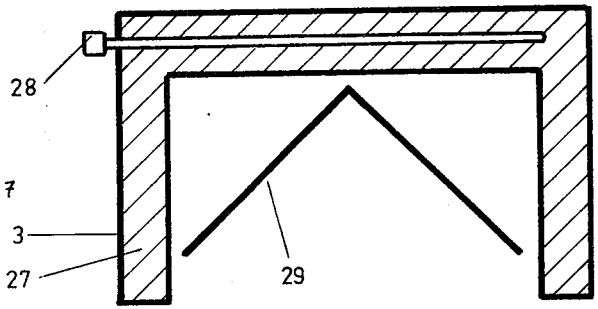
FIG. 7 schematically shows another embodiment of the treatment chamber.

A holding plate 34 provided with a depositing face 57 coplanar with the depositing face 35 of disc 5 surrounds said disc 5 and is firmly mounted on the sheave body 11. According to a characteristic of invention, the shaft 6 of the depositing disc 5 is hollow and formed with an inner axially extending bore 15 prolongating into depositing disc 5. As shown on FIG. 8, a radially extending bore 16 is formed in said disc 5 and opens at one end in an axially extending bore 15. A transversally extending bore 18 establishes a communication between the bore 16 and the face 35 of the depositing disc 5 to form the yarn extraction orifice. A sleeve 19 made of a stout material such as ceramics is shrunk on in bore 18 to avoid undue wear of extraction orifice 36. Previously to the mounting of the rotating assembly in the sheave or eccentric body 11, the drilling mouth of bore 16 is stopped up by a stop plug 17 which is for instance press fitted in the bore. The yarn 2 to be treated is introduced at the outer end of the axially cotending bore 15 opposite to depositing disc 5 by a shaped sleeve 37 made of a stout material, then axially passes through the bore 15 in the shaft 6 and the bore 16 in the disc 5 to leave by itself said disc through the extraction orifice 36.

The yarn 2 supplied from the supplying reel 9 through driving rolls 45 emerges from said disc through the extraction orifice 36 and, in continuous operation of the device, the differential adhesiveness of the yarn between the buffed face 35 of disc 5 and the cushion of yarns constituted by the immediately adjacent portion of the cylindrical winding 10 downstream the depositing disc makes, through rotation of disc 5, the yarn deposit in the form of a circle. The sheave assembly 11 allows the axis 51 of disc 5 to rotate around imaginary axis 50 so as to have the yarn deposited in the form of successive turns which are more or less jointing. Said more or less jointing successive turns deposited along an annulus around the rotation centre determined by the imaginary axis 50 forms successive turn layers laying one onto each other to constitute the continuous cylindrical winding of yarn 10 which has the form of a flexible hollow cylinder having an annular cross-sectional area, examples of which are designated by reference numerals 52 on FIG. 2 and 53 on FIG. 6. The holding plate 34 allows the upstream face or layer of the cylindrical winding to be maintained in the depositing plane. Since the rotation speed of the depositing disc 5, and accordingly the depositing speed of the yarn, are controllable, as also the rotating speed of the sheave assembly, it is possible to make vary the pitch between the turns successively deposited one against each other with respect to the yarn size, so as to control the density of the cylindrical winding of yarn, i.e., the unitary bulk of the winding and in fine the rate of yarn treated within the treatment chamber.

As it appears from the foregoing, the depositing mode of the invention requires the cylindrical winding 10 to be permanently brought into intimate contact with the depositing disc 5 and moreover to be maintained in pressure contact therewith under a predetermined pressure. Said contact pressure of the yarn deposited against the disc 5 is reached by the yarn itself, e.g., by the winding 10, which is forced to pass through a conical forming device 20 designed to restrain the forwarding speed of the cylindrical winding 10 before it emerges therefrom to be deposited onto conveyor belt 22. Leaf springs 21 of a convenient shape are advantageously disposed within the inlet portion of the forming device 20 to achieve an additional reduction of the forwarding speed of the cylindrical winding. Said leaf springs 21 can be mounted, in a preferred embodiment, so as to have their relative position controllable as also the pressure exerted onto the winding by said springs.

In order to initiate the pressure cooperating mode between the depositing disc 5 and the portion of the cylindrical winding disc which has just been formed, there is required a particular starting operation for the above described depositing device. At the very beginning of the depositing process, the device 20 contains no yarn for inducing a counter pressure against the depositing disc. Accordingly, the starting step is made possible by the insertion of a plug, made for instance from a foam rubber, within the shaping device 20 so as to realize a stuffing wad between said shaping device and the depositing disc. As the cylindrical winding disc is formed in front of the depositing disc, the rubber stuffing wad is ejected from the shaping device 20 and the continuous process of forming of the cylindrical winding disc will proceed according to the rotational speed of the depositing head, i.e., according to a predetermined amount per hour of yarns to be treated.

Figure 3:
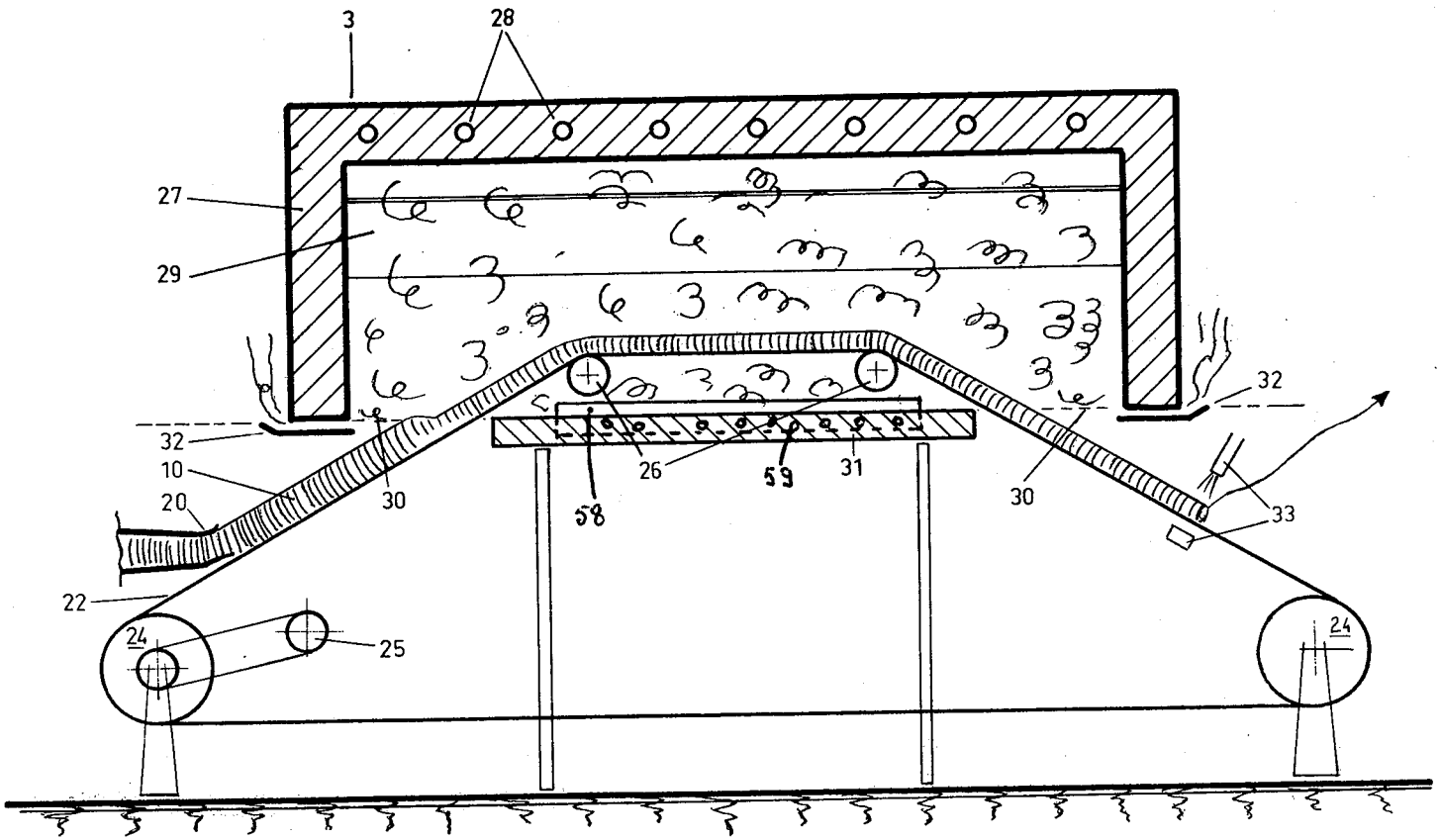
FIG. 3 shows a particular embodiment of the treatment chamber.

FIG. 3 illustrates a favorite embodiment of the thermal treatment apparatus. In said embodiment, the treatment chamber 3 has a shape of a hood, i.e., of a tank turned upside down. Said chamber is heat insulated by a heat insulating means 27 and may comprise at its upper closed end electrical resistors 28 and an inside roof unit 29 having two slanted walls to prevent condensate to be formed or to fall onto the yarn. In addition, there is provided gutter means 32 underneath the lateral walls or tank 3 at the level of the inlet or outlet openings 30 so as to prevent the condensate developed onto said walls of dripping onto the yarns transported by the conveyor belt 22.

The treatment fluid consisting essentially in saturated or superheated steam, said treatment fluid may be generated outside from the treatment chamber and fed thereto or directly generated therein. Saturated steam may be for instance produced within a water container 58 arranged on the bottom wall 31 of the treatment chamber and equipped with electric resistors to make the water therein boil and evaporate in such conditions. The steam which has been produced fills the steam bell 3 and can be superheated by the electric resistors 28 or by steam heated coils arranged in a convenient manner within the chamber.

The hood-shaped configuration of the treating chamber offers many advantages. With a chamber of the bell type, said chamber only contains air-free steam whereby allowing, more particularly when using saturated steam, the maximum desirable treatment temperature to be reached within the chamber. Depending from the way the steam is fed into the chamber free, the steam in excess will be exhausted through openings 30 which correspond to the lower level of the chamber, and more particularly to the inlet and outlet levels, respectively, for the yarns to be treated within the chamber.

As shown on FIGS. 1 and 3, and according to a further characteristic of the preferred apparatus, the conveyor belt 22 which is driven by driving rolls 24 defines a conveying pass having substantially a trapezoidal form, the cylindrical winding or coil of yarns to be treated 10 being deposited along a generatrix of the cylinder onto the conveyor belt 22 in its upwardly directed portion, at a level beneath the lowest level of the treating chamber 3 to be transported within chamber 3 by the conveyor belt 22 turning around deflecting rollers 26 in a zone above the zone of fluid interferences, whirls and losses between the treatment fluid and the ambient air, the treated yarn leaving the chamber by the descending portion of the conveyor belt to be reeled in the taking up device 4. As shown on FIG. 3, the thermal treatment of the cylindrical winding 10 of yarns starts at the very moment when the winding passes the inlet opening 30 corresponding to lower level of the treatment chamber, the treatment of the corresponding portion of the cylindrical winding going on during a time determined with respect to the desired amount per hour required in such an apparatus with a perfectly pure treatment fluid. The winding of yarns then is submitted to a thermal surge as soon as it has passed the opening 30, that means that the yarn begins to retract, swell and stabilize as soon it has entered the treatment chamber. The very low density of the winding allows the steam to better penetrate the yarn, whereby resulting in a more regular and uniform treatment of the yarn within the treatment chamber.

At the outlet end of chamber 3, the taking up device 4 may consist in a reeling machine or an apparatus for making industrial cakes of great dimensions for the production of yarns spools for the knitting, the weaving or for directly feeding ball-winding machine.

The taking up speed of the yarn will be determined with respect to the depositing speed of the yarn in the depositing device 1 at the inlet portion of the apparatus and also to the shrinking of the yarn during its thermal treatment. There is provided at the outlet of the conveying pass for the yarn within the fluid chamber a photo electric cell 33 for detecting the position of the yarn winding 10 on the conveyor belt 22 and for controlling the taking up speed of the yarn to have the different stations embodied in the treatment process synchronised and to ensure an automatic taking up of the yarn without additional handling or specific watching.

The speed of the conveyor belt 22 can be varied in a controllable manner and can be determined in function of the delivery speed of the cylindrical winding 10 from the shaping device 20. The running speed of the conveyor belt is generally greater than the delivery speed of the cylindrical yarn winding to separate the layers of yarn turns one from each other in the cylindrical winding in order to better separate the yarns one from each other and allowing same to freely bulk and shrink with a maximum efficiency when they are treated within the chamber 3 to achieve improved swelling and bulking of said yarn. The separation between successive turns layers can be improved, more particularly for the yarn having great bulking properties, for instance by means of barbed rollers 23 mechanically driven so as to reach a peripheral speed substantially equal to the running speed of the conveyor belt 22. Said barbed rollers may be substituted by other mechanical devices such as for instance serrated or toothed belts, such a device providing for a positive contact with the cylindrical winding of yarns along a greater distance than with the rollers.

Figure 6:
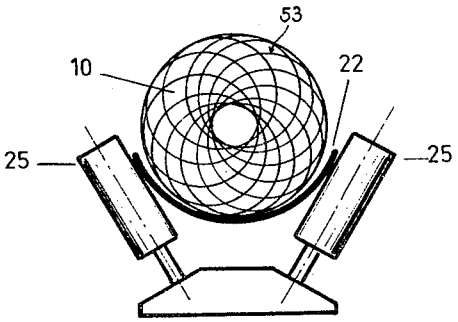
FIGS. 4, 5 and 6 schematically show detailed portions of the conveying mechanism for transporting the cylindrical winding.
Figure 4:
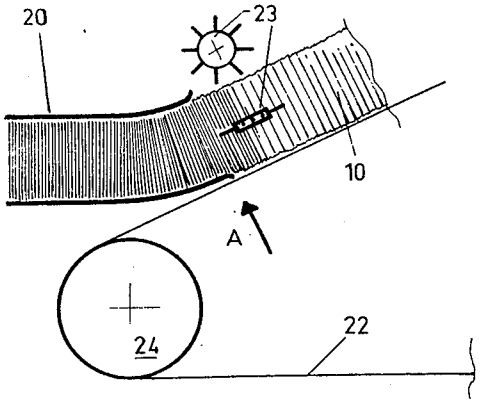
Figure 5:
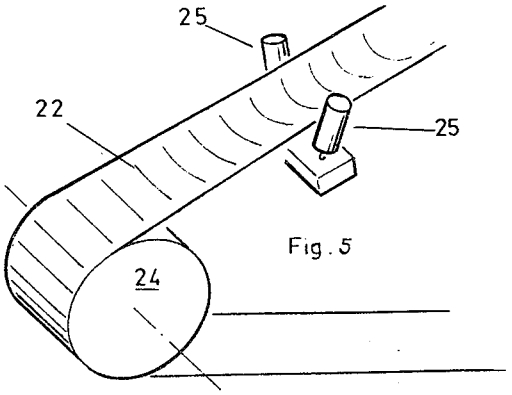

The cylindrical winding 10 having a circular cross-section varying in a controllable manner, there is provided a device comprising for instance two guiding rolls 25 driven by the motor 25 for distorting the conveyor belt 22 so as said belt presents a rounded shape adapted to substantially mate a portion of the outer surface of the cylindrical winding 10, as shown on FIGS. 5 and 6. With such an arrangement the cylindrical winding is lying onto the conveyor belt along a curved peripheral surface portion thereof, instead of a single generatrix as in the case of a flat conveyor belt; thus the winding is laterally guided and better held, whereby the structural cohesiveness of said winding is kept.

It will be understood from the foregoing that the present invention offers a double advantage: on one hand, the realization of a cylindrical yarn winding lying along at least a generatrix of the cylinder onto a conveyor belt allows, in a treatment installation having predetermined dimensions, for a considerable increasing of the surface or bulk of the yarns to be treated which pass through the treatment chamber 3 per a predetermined time unit. On the other hand, the hollow cylindrical configuration of the stratified yarn winding 10 allows the treatment fluid to better penetrate the yarn, whereby resulting in an improved treatment efficiency. Moreover, the process for the continuous treatment of the yarns comprising the steps of transporting the cylindrical record winding yarn along a pass successively ascending, horizontal and descending for transversing a hood-shaped treatment chamber permits to proceed with a thermal treatment of the yarn in the better conditions, more particularly at the maximum available temperature for the considered treatment fluid and with such a treatment fluid being in a very pure state, free from hot air, whereby there is prevented oxidization of the yarn and accordingly modifications of its dye affinity, variations of its colour shades for the fiber materials which have been dyed prior to the spinning process, any modifications of the outer structure of the fiber susceptible of resulting in a finished yarn rough to the touch and accordingly less pleasant and, in the case of natural fibers, a bad overdrying. Moreover, the process of the invention ensures a higher production speed for any kind of yarn, more particularly for the small sized yarns since it permits a very high working speed while achieving an efficiency higher than the efficiency customary admitted for such threads.

While particular embodiments of the invention have been described, it will be understood that modifications and changes in these embodiments may be made by those skill in the art without departing from the spirit and scope of the invention as defined in the appended claims.

What we claim is:

1. A process for continuous heat treatment of yarns comprising the steps of forming a continuous flexible hollow coherent cylindrical winding formed by successive annular layers of yarn turns, of depositing said cylindrical winding on a conveyor belt with said cylindrical winding being supported at least along a generatrix thereof onto said conveyor belt, and of making said conveyor belt transport said cylindrical yarn winding within a stationary hoodshaped treatment chamber having a closed top portion and an at least partially open lower portion, treatment fluid being introduced within said treatment chamber and maintained therein in a very pure state through relative density effect.

2. A process according to claim 1, wherein the cylindrical yarn winding extends substantially horizontally, newly formed annular layers aggregating the already formed annular layers, whereby pushing same and causing the cylindrical winding to be continuously pushed and thereby deposited on said conveyor belt.

3. A process according to claim 1 comprising the step of conveying said cylindrical yarn winding through said heat treatment chamber along a path successively ascendin horizontal and descending, the cylindrical yarn winding being deposited onto said conveyor belt underneath said lower portion of said treatment chamber and being taken up after the termination of the heat treatment also underneath said lower portion of said chamber.

4. A process according to claim 3, wherein said cylindrical yarn winding is obtained by means of a rotating depositing disc driven by a horizontally extending driving shaft and having a planar surface extending in a substantially vertical plane and comprising an extraction orifice, said depositing disc being adapted to rotate around a first horizontal axis which is in turn adapted to move along a circular path around a second horizontal axis, said cylindrical winding having its upstream portion, adjacent said depositing disc, being maintained in cooperative pressure contact with said planar face of said depositing disc by means of a substantially frustoconical hollow stuffing device at the end of which the cylindrical yarn winding is deposited onto said conveyor belt.

5. A process according to claim 4, wherein said yarn is supplied to said depositing disc through an axial portion of said disc, said disc being provided with an inner conduit connecting said axial portion to said extraction orifice.

6. A process according to claim 5, wherein said yarn is supplied to said axial portion of said depositing disc through an axially extending bore formed within said driving shaft.

7. A process according to claim 6, wherein said layers of yarn turns forming said cylindrical yarn winding are slightly separated one from each other before they enter said treatment chamber.

8. A process according to claim 7, wherein said yarn or yarns forming said cylindrical winding are taken up by a taking up device after they are passed through said treatment chamber.

9. A process for continuous heat treatment of yarns, comprising:

(a) forming a continuous, flexible hollow, cylindrical winding constituted by an axially extending series of successive annular layers of helical turns of yarn, each such layer being constituted by an angularly distributed plurality of such helical turns;

(b) depositing said cylindrical winding on an advancing conveyor belt so that the longitudinal axis of the cylindrical winding substantially parallels the advance of the conveyor belt and the cylindrical winding is supported on at least a generatrix thereof on said conveyor belt;

(c) establishing and maintaining a bell-like vapor-phase treatment chamber for lighter-than-air vaporous treating fluid, by introducing sufficient vaporous treating fluid into the treatment chamber to have an excess thereof venting therefrom below where said cylindrical winding is to be treated therein;

(d) advancing said conveyor belt, with said cylindrical winding supported thereon into, through and out of said treatment chamber, always at such a level as to ensure that the cylindrical winding, while in said treatment chamber, is being bathed in vaporous treating fluid that is substantially uncontaminated by air.

* * * * *